US005372275A

United States Patent [19]

Yeh

[11] Patent Number: 5,372,275

[45] Date of Patent: Dec. 13, 1994

[54] MUG AND LID COMBINATION

[76] Inventor: Frank Yeh, 1019 N. Mayflower St., Anaheim, Calif. 92801

[21] Appl. No.: 175,614

[22] Filed: Dec. 30, 1993

[51] Int. Cl.[5] ..... B65D 39/00

[52] U.S. Cl. ..... 220/713; 220/307; 215/307

[58] Field of Search ..... 220/307, 296, 293, 292, 220/713, 711; 215/387, 307, 319, 332, 384

[56] References Cited

U.S. PATENT DOCUMENTS

| | | | |
|---|---|---|---|
| 2,437,784 | 9/1944 | Laskin . | |
| 3,140,799 | 7/1964 | Mehr . | |
| 4,243,156 | 1/1981 | Lobbestael . | |
| 4,303,170 | 12/1981 | Panicci . | |
| 4,582,218 | 4/1986 | Ross . | |
| 4,761,319 | 8/1988 | Kraus et al. | 220/307 |
| 4,883,194 | 11/1989 | Fernandes | 220/307 |
| 4,986,437 | 1/1991 | Farmer . | |
| 5,018,636 | 5/1991 | Ross . | |
| 5,018,636 | 5/1991 | Ross | 220/307 |
| 5,102,000 | 7/1992 | Feltman, III . | |
| 5,150,803 | 9/1992 | Cartellone | 220/307 |
| 5,176,278 | 1/1993 | Quarberg | 220/729 |
| 5,217,141 | 6/1993 | Ross . | |
| 5,249,703 | 10/1993 | Karp . | |

*Primary Examiner*—Joseph Man-Fu Moy
*Attorney, Agent, or Firm*—Raymond Sun

[57] ABSTRACT

A mug and lid combination comprises a lid having a cylindrical wall and a plurality of retaining means. Each retaining means comprises two longitudinal slits provided along the cylindrical wall and extending from a bottom edge of the cylindrical wall to a mid-section of the cylindrical wall, the two slits defining a portion of the cylindrical wall therebetween. The retaining means further comprises a protrusion provided on the external surface of the portion of the cylindrical wall between the slits. The combination further comprises a mug comprising a hollow section for holding liquids, and a lip section at the mouth of the mug. The mug further includes a concave ring section connected to the lip section of the mug at a neck, the concave ring section having a central diameter greater than the diameter of the neck. The concave ring section is adapted to receive the protrusions. The portions of the cylindrical wall between the slits may be flexed to allow the protrusions to be passed through the neck and to be removably fitted in the concave ring section.

7 Claims, 3 Drawing Sheets

MUG AND LID COMBINATION

BACKGROUND OF THE INVENTION

1. Field of the Invention

The present invention relates to a unique combined safety lid and mug, and in particular, to a mug and lid combination in which the lid is provided with means for securely retaining the, lid at the mouth of the mug to effectively seal the mouth of the mug and prevent spillage of the liquid contained therein.

2. Description of the Related Art

Many of the currently-available lids suffer from a number drawbacks, the most serious being that these lids are not securely retained at the mouth of the mug, which allows spillage of the liquid if the mug is tipped over. Some of these lids also make it inconvenient for a user to drink from the mug since an insecure lid usually means that the user must hold the lid while drinking.

Several attempts have been made to remedy this drawback. For example, snap-fit lids were provided, but they are unreliable since they must be entirely snapped in place to be effective.

Another example is U.S. Pat. No. 4,582,218 to Ross, which discloses a mug 10 which is specifically provided with a recessed shelf 30 extending inwardly from the internal wall 20 of the mug 10. Gaps 32 are provided in the shelf 30. A lid 40 is provided with tongues 48 and 50, which are adapted to be inserted through the gaps 32. The lid 40 is then rotated about the shelf 30 to secure the lid 40 to the mouth of the mug 10. However, the mug and lid combination of U.S. Pat. No. 4,582,218 suffers from the drawback that it is neither reliable nor convenient to use, since the user must ensure that the tongues 48 and 50 have been inserted all the way through the gaps 32 before rotating the lid 40. If the tongues 48 and 50 are not rotated sufficiently far away from the gaps 32, then the lid 40 is not securely retained. Further, the securing mechanism utilized by U.S. Pat. No. 4,582,218 requires precise interaction between the various elements of the mug 10 and the lid 40. Since the nature of ceramic makes it difficult to manufacture ceramic mugs to meet precise sizes and shapes, the user may therefore find the lid 40 difficult to use with a ceramic mug and possibly unreliable.

As a further example, U.S. Pat. No. 5,018,636 to Ross also discloses a mug 10 with a recessed shelf 30. However, the lid 40 is provided with a pair of retaining means 60 and 70, in the form of a flexible elongated rod 62 or 72 extending from the lower surface 46 of the lid 40 and having a spherical ball 64 or 66 provided at the end of the rod 62. In use, the lid 40 may be inserted into the mug 10 such that the lower surface 46 of the lid 40 rests on the upper portion 31 of the recess 30, with the flexible rods 62 and 72 bent inwardly, and the balls 64 and 66 resting adjacent the lower portion 38 of the recess 30. However, the lid 40 of U.S. Pat. No. 5,018,636 suffers from the drawback that the rods 62 or 72 are very fragile and are easily broken.

Yet another example is U.S. Pat. No. 5,102,000 to Feltman, III, which discloses a mug 11 having an inwardly projecting ring 16 with vertical passages 17 and latch notches 18 formed in the ring 16. The lid 15 has a pair of flexible fingers 30, each having a rounded end 29. In use, the lid 15 is inserted into the mouth of the mug 11 such that the rounded ends 29 pass through the vertical passages 17. The lid 15 is then rotated so that the rounded ends 29 are fitted in the latch notches 18 to provide a secure fit. However, like the lid 40 of U.S. Pat. No. 5,018,636, the lid 15 of U.S. Pat. No. 5,102,000 also suffers from the drawback that the fingers 30 are very fragile and are easily broken.

As yet another example, U.S. Pat. No. 5,217,141 to Ross discloses a lid 205 having a flexible lid sheet 240 sandwiched between a finger pull piece 200 and a lock post part 300. The mug 10 has a ring section 40 comprising a concave inner ring surface 160. The lid 205 may be pushed downwardly through an inner ring/lip interface diameter 80 of the concave inner ring surface 160 and frictionally fitted in the lid cavity diameter 75. The inner truncation diameter 70 is smaller than the lid cavity diameter 75 to support the lid 205 and to prevent the lid 205 from dropping into the chamber 25 of the mug 10. However, the mug and lid combination of U.S. Pat. No. 5,217,141 does not operate reliably and effectively. For example, it is not easy to provide a lid sheet 240 that is sufficiently flexible so that it would be relatively easy to insert the lid 205 into the concave inner ring surface 160 and to remove the lid 205. A lid sheet 240 that is too stiff will be very difficult to use. Likewise, a lid sheet 240 that is too flexible may cause the lid 205 to slip pass the inner truncation diameter 70 and into the chamber 25 of the mug 10 if the lid 205 is pushed too hard. Further, the construction of the lid 205 is complex because three separate components are required.

Thus, there remains a need for a mug and lid combination that is easy to use, can be provided at low cost, and which effectively secures the lid to the mouth of the mug to prevent spillage.

SUMMARY OF THE INVENTION

The objects of the present invention may be achieved by providing a drinking mug and lid combination. The combination comprises a lid comprising a hollow cylindrical section having a cylindrical wall, the cylindrical wall comprising a plurality of retaining means. Each retaining means comprises two longitudinal slits provided along the cylindrical wall and extending from a bottom edge of the cylindrical wall to a midsection of the cylindrical wall, the two slits defining a portion of the cylindrical wall therebetween. The retaining means further comprises a protrusion provided on the external surface of the portion of the cylindrical wall between the slits.

The lid further comprises a handle section connected to the inner surface of the cylindrical wall, the handle section comprising a planar support surface and a handle extending upwardly from the planar support surface. Ribs may be provided on the handle to enhance the grip. A longitudinal channel is cut along a portion of the cylindrical wall to allow liquid to flow from the hollow section of the mug through the lid. A flared upper section extends outwardly at an angle from the upper edge of the cylindrical wall.

The combination further comprises a mug comprising a hollow section for holding liquids, and a lip section at the mouth of the mug. The mug further comprises a concave ring section connected to the lip section at a neck, the concave ring section having a central diameter greater than the diameter of the neck. The concave ring section is adapted to receive the protrusions of the plurality of retaining means. The portions of the cylindrical wall between the slits may be flexed to allow the protrusions to be passed through the neck and to be removably fitted in the concave ring section.

The lip section of the mug comprises a lip rim having an outermost edge, the lip rim extending outwardly at an angle from the neck such that the diameter at the outermost edge is larger than the diameter at the neck. The lip rim of the mug is adapted to receive the flared upper section of the lid to prevent the lid from being pushed through the concave ring section and into the hollow section of the mug.

Therefore, the retaining means of the lid provides an effective means for securing the lid at the mouth of the mug. The lid is both easy to use and is reliable. The lid is also easy to manufacture and can be provided at low cost.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
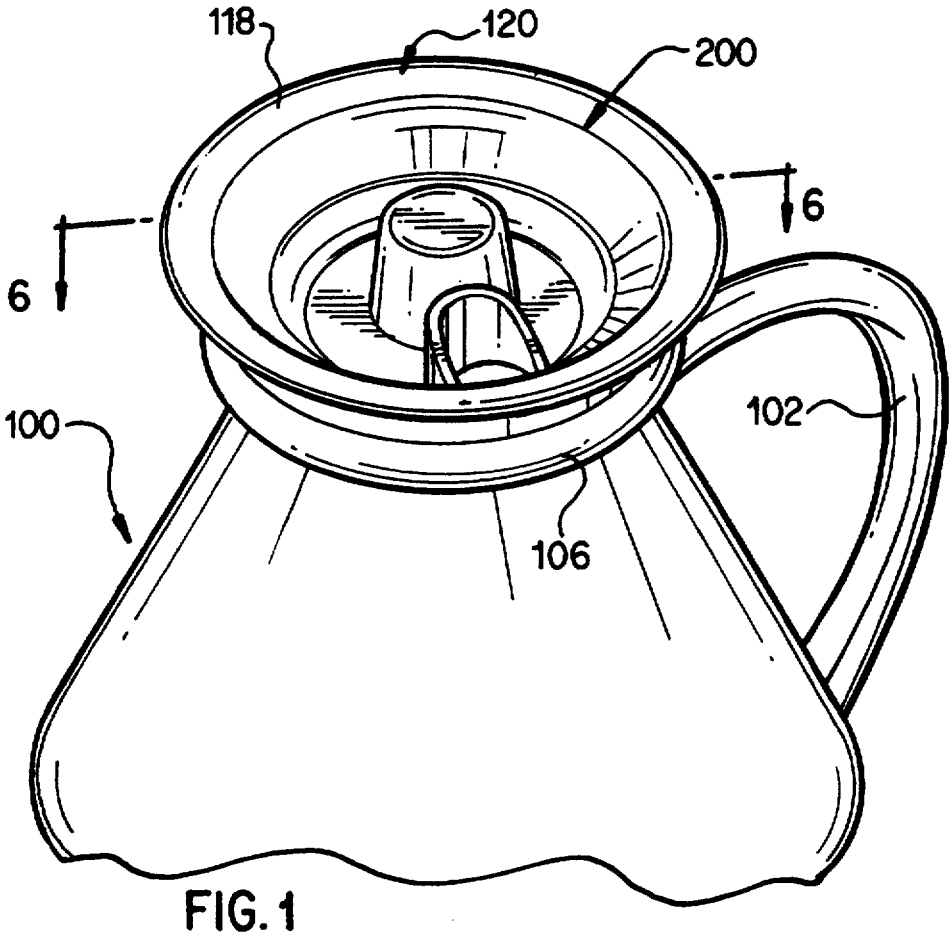
FIG. 1 is a perspective view of a first embodiment of the mug and lid of the present invention, in which the lid is shown secured at the mouth of the mug.
Figure 6:
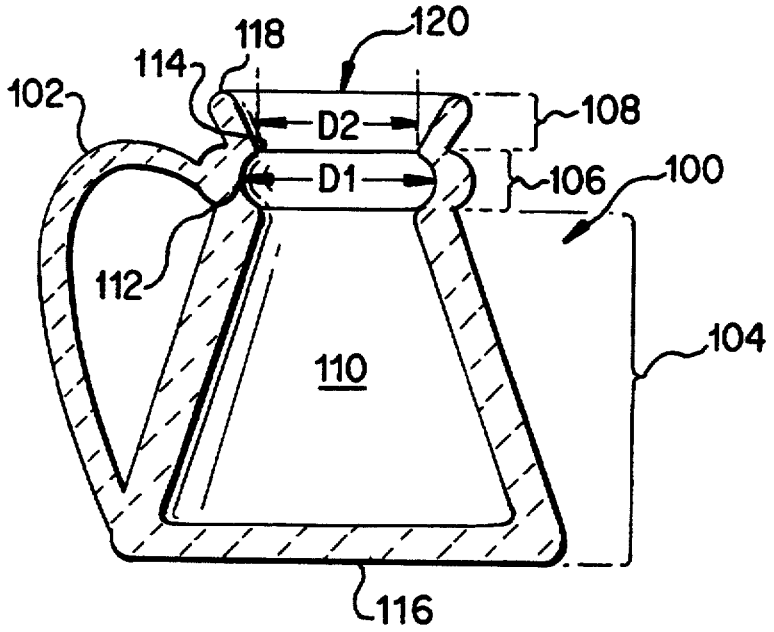
FIG. 6 is a cross-sectional side view of the mug of FIG. 1 taken along line 6—6 of FIG. 1.

FIG. 1 illustrates a mug 100 and a lid 200 in use in accordance with a preferred embodiment of the present invention. Referring to FIGS. 1 and 6, the mug 100 has a handle 102 and is divided into three sections: a hollow frustum section 104, a concave ring section 106, and a lip section 108. All three sections are preferably provided in integral manner, although it would be possible to provide the three sections as separate components and to connect them by using conventional connection means.

The hollow frustum section 104 defines an inner chamber 110 for holding liquids. The hollow frustum section 104 derives its shape from a truncated cone, with a base 116 that is wider at the bottom than the width at the top of the hollow frustum section 104. The base 116 may also be weighted to prevent the mug 100 from tipping when in use. Therefore, the shape and weight of the hollow frustum section 104 provide stability to the mug 100. The concave ring section 106 comprises a concave inner surface 112 having a central diameter D1 that is larger than the diameter D2 of the neck 114 which connects the lip section 108 and the concave ring section 106. The lip section 108 has a lip rim 118 that is smoothly rounded to prevent abrasion to a user's lips when drinking from the mug 100. The lip rim 118 is flared outwardly at an angle such that the diameter at its outermost edge 120 is wider than the diameter at the neck 114.

The mug 100 is preferably made from ceramic but may also be made from plastic, glass or other similar material.

The lid 200 will be described in connection with FIGS. 2–5. Referring specifically to FIGS. 3 and 5, the lid 200 comprises three sections: an upper flared section 202, a lower cylindrical section 204, and a handle section 230. The upper flared section 202 is comprised of an annular lip 206 that extends from the upper edge 208 of the lower cylindrical section 204. The annular lip 206 flares outwardly at an angle such that its diameter at its outermost edge 210 is wider than the diameter of its lower edge which connects to the upper edge 208 of the lower cylindrical section 204.

The lower cylindrical section 204 is preferably hollow and comprises a substantially cylindrical wall 212. A plurality of retaining means 214 are provided in spaced-apart manner along the cylindrical wall 212. The retaining means 214 operate to retain the lid 200 securely in place at the concave ring section 106 and the lip section 108 of the mug 100.

In a preferred embodiment, the retaining means 214 comprises two longitudinal slits 216 and 218 that extend from the bottom edge 220 of the lower cylindrical section 204 to about a midsection of the lower cylindrical section 204. A narrow protrusion 224 is provided on the external surface of the cylindrical wall 212 at the portion 222 of the cylindrical wall 212 between the slits 216 and 218. The protrusion 224 preferably has a length which is slightly less than the height of the concave ring section 106 of the mug 100 so that the protrusion 224 can be fitted therein. The slits 216 and 218 are provided so that the portion 222 of the cylindrical wall 212 can be flexed inwardly; the operation and purpose will be explained in greater detail below. The length of the slits 216 and 218 control the degree to which the portion 222 can be flexed: longer slits 216 and 218 allow more flexibility, while shorter slits 216 and 218 provide less flexibility.

There are preferably two or three such retaining means 214 provided in spaced-apart manner around the cylindrical wall 212. The preferred embodiment of FIGS. 1–6 is shown as having three retaining means 214, but any number (i.e., two or more) of such retaining means 214 can be provided without departing from the spirit or scope of the present invention. The dimensions of the retaining means 214 are also not critical, except that the protrusions 224 must be of a size that they can be fitted in the concave ring section 106 of the mug 100. For example, the slits 216 and 218 may have a lesser length, and the distance between the slits 216 and 218 defining the portion 222 can be smaller, thereby producing a smaller retaining means 214. With smaller retaining means 214, it is possible to provide a larger number of such retaining means 214 spaced-apart around the cylindrical wall 212.

Figure 2:
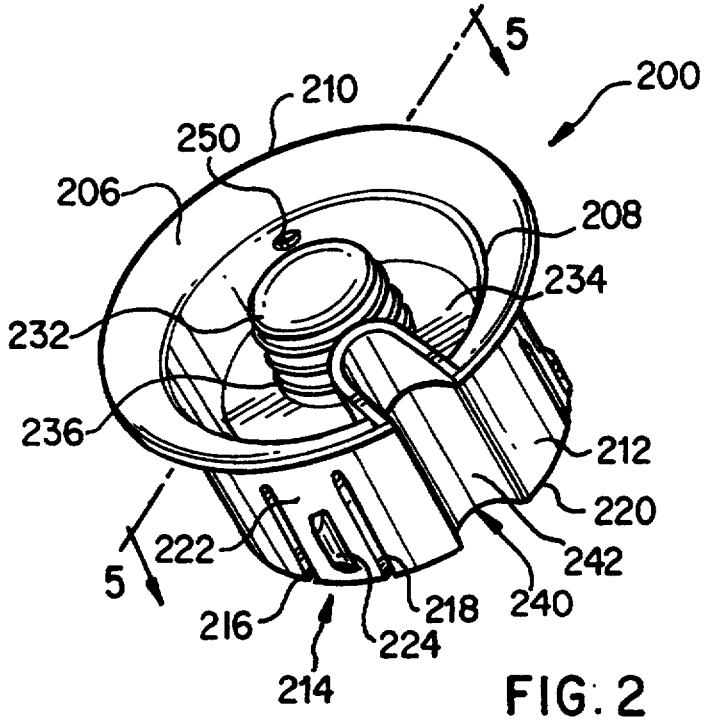
FIG. 2 is a perspective view of the lid of FIG. 1.
Figure 3:
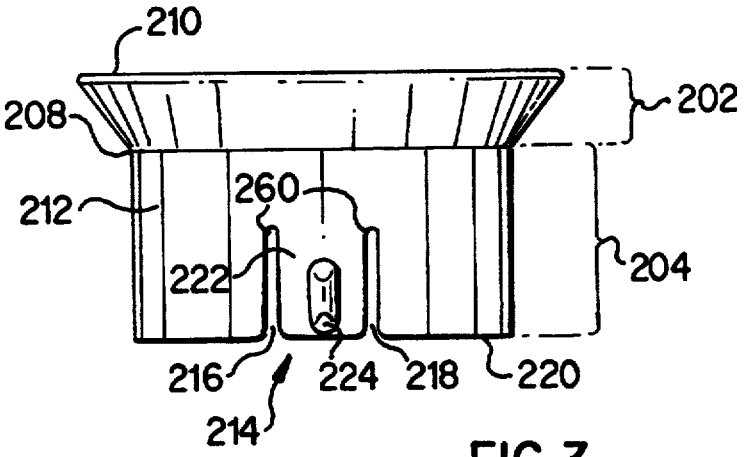
FIG. 3 is a side view of the lid of FIG. 2.
Figure 4:
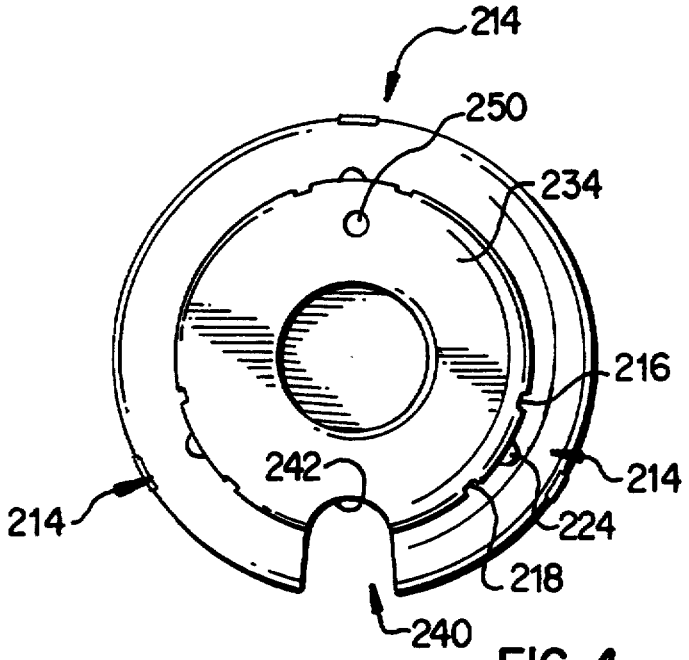
FIG. 4 is a bottom plan view of the lid of FIG. 2.
Figure 5:
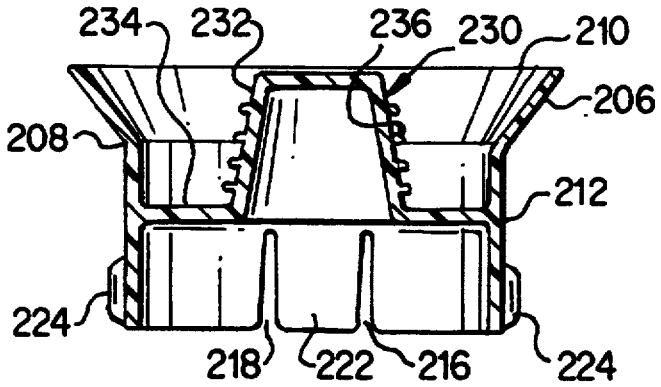
FIG. 5 is a cross-sectional side view of the lid of FIG. 2 taken along line 5—5 of FIG. 2.

Referring to FIGS. 2, 4 and 5, the handle section 230 of the lid 200 is provided in the hollow interior of the upper flared section 202 and the lower cylindrical section 204. The handle section 230 comprises a handle 232 which extends from a planar support surface 234. The planar support surface 234 is substantially circular in shape and is provided at a section of the inner surface of the cylindrical wall 212 at or above the uppermost limit 260 of the slits 216 and 218. The handle 232 is shown as having a frusto-conical shape, but can be cylindrically-shaped as well. The handle 232 may also be hollow and extends upwardly from a central portion of the planar support surface 234 to a height sufficient for a user to firmly grip the handle 232 with his or her fingers. Ribs 236 may be provided on the handle 232 to provide better grip.

Other handles may be provided without departing from the spirit and scope of the present invention. For example, instead of the hollow handle 232, a handle bar (not shown) or cross-shaped handle (not shown) may be provided.

The lid 200 further comprises a longitudinal channel 240 which is formed along a portion of the cylindrical wall 212. The channel 240 comprises a concave surface 242 to define a semi-circular shape. The channel 240 allows liquid to flow from the chamber 110 of the mug 100 to the outside of the mug 100 while the lid 200 is secured in place. Thus, the cylindrical wall 212 is not exactly cylindrical throughout since it has the channel 240 formed along a portion thereof. An opening 250 is provided along the planar support surface 234 to allow for proper release of pressure, thereby making it easier for liquid to flow out of the mug 100.

In operation, the lid 200 may be secured at the concave ring section 106 and the lip section 108 of the mug 100 in the following manner. The lid 200 is first inserted into the lip section 108 of the mug 100. The diameter D2 of the neck 114 is less than the central diameter D1 of the concave inner surface 112 of the concave ring section 106, so the portions 222 of the cylindrical wall 212 are flexed inwardly to allow the protrusions 224 of the plurality of retaining means 214 to pass through the neck 114 and into the concave ring section 106. The protrusions 224 are adapted to fit inside the concave ring section 106. Further, the flared configuration of the annular lid 206 is conformed to the flared configuration of the lip section 108 of the mug 100 so that the lid 200 cannot be pushed into the chamber 110 of the mug 100. To remove the lid 200, the user grips the handle 232 and pulls the lid 200 from the mug 100. The flexibility of the portions 222 again allow the protrusions 224 to pass through the neck 114 and to disengage from the mug 100. However, the force required to pull the lid 200 from the mug 100 is much greater than the normal forces encountered by the mug and lid combination during conventional use, so the lid 200 can be securely retained during normal use.

Figure 7:
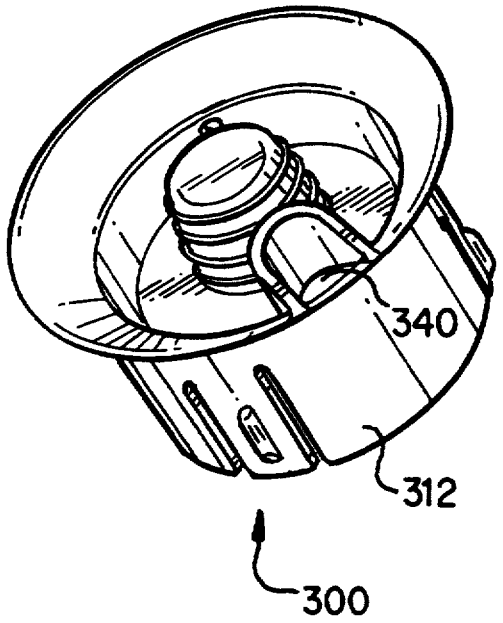
FIG. 7 is a perspective view of a second embodiment of a lid according to the present invention.

FIG. 7 illustrates an alternative embodiment of a lid 300 according to the present invention. The lid 300 is essentially the same as the lid 200 but its channel 340 is not exposed as with channel 240 of lid 200. Instead, the channel 340 is enclosed by the cylindrical wall 312.

The upper flared section 202, the lower cylindrical section 204, and the handle section 230 of the lid 200 may be integrally formed, or may be formed from separate components. The lid 200 and its three sections are preferably made from a flexible and non-toxic material such as polypropylene, polyethylene, polystyrene, or bamboo which is sufficiently stiff yet can be flexed to allow the portions 222 to be easily flexed for the protrusions to pass through the neck 114.

Therefore, the retaining means 214 of the lid 200 provide an effective means for retaining the lid 200 at the concave ring section 106 and the lip section 108 of the mug 100. The operation and use of the lid 200 is simple in that the user only needs to push it into the mouth of the mug 100 to use it, and to grip the handle 232 and pull to remove it. The flexibility of the portions 222 of the cylindrical wall 212 allows the lid 200 to operate in a reliable manner even when used with ceramic mugs that are not provided in the precise sizes and shapes. The lid 200 has a simple construction and can be produced at low cost.

While the description above refers to particular embodiments of the present invention, it will be understood that many modifications may be made without departing from the spirit thereof.

What is claimed is:

1. A mug and lid combination, comprising:

(a) a mug comprising a mouth, a hollow section for holding liquids, and a concave ring section connected to the mouth at a neck, the concave ring section having a central diameter greater than the diameter of the neck, with each of the mouth, the neck and the concave ring section having a predetermined shape and size, the mug made from a material which makes the mouth, the neck and the concave ring section to varying shapes and sizes differing from their predetermined shapes and sizes; and (b) a lid comprising a hollow cylindrical section having a substantially cylindrical wall, the cylindrical wall comprising a bottom edge and an external surface, the lid further comprising a plurality of retaining means, each retaining means comprising:

(i) two longitudinal slits provided along the cylindrical wall and extending from the bottom edge of the cylindrical wall to a mid-section of the cylindrical wall, the two slits defining a portion of the cylindrical wall therebetween;

(ii) a protrusion provided on the external surface of the portion of the cylindrical wall between the slits;

(c) wherein the portions of the cylindrical wall between the slits of each of the plurality of retaining means may be flexed to allow the protrusions to be passed through the neck of the mug and to be removably fitted in the concave ring section of the mug.

2. The combination of claim 1, wherein the cylindrical wall of the lid further comprises an inner surface, and the lid further comprises a handle section connected to the inner surface of the cylindrical wall, the handle section comprising a planar support surface and a handle extending upwardly from the planar support surface.

3. The combination of claim 1, wherein the lid further comprises a longitudinal channel formed along a portion of the cylindrical wall to allow liquid to flow from the hollow section of the mug through the lid.

4. The combination of claim 1, wherein the cylindrical wall comprises an upper edge and the lid further comprises a flared upper section extending outwardly at an angle from the upper edge of the cylindrical wall.

5. The combination of claim 4, wherein the mouth of the mug comprises a lip rim having an outermost edge, the lip rim extending outwardly at an angle from the neck such that the diameter at the outermost edge is larger than the diameter of the neck.

6. The combination of claim 5, wherein the lip rim of the mug is adapted to receive the flared upper section of the lid to prevent the lid from being pushed through the concave ring section and into the hollow section of the mug.

7. The combination of claim 2, wherein the handle further comprises a plurality of ribs for enhancing grip.

* * * * *